US012187530B2

(12) United States Patent
Shepherd

(10) Patent No.: US 12,187,530 B2
(45) Date of Patent: Jan. 7, 2025

(54) CORRUGATED STORAGE CONTAINER

(71) Applicant: SANDBOX ENTERPRISES, LLC, Katy, TX (US)

(72) Inventor: Justin Shepherd, Houston, TX (US)

(73) Assignee: SANDBOX ENTERPRISES, LLC, Katy, TX (US)

( * ) Notice: Subject to any disclaimer, the term of this patent is extended or adjusted under 35 U.S.C. 154(b) by 316 days.

(21) Appl. No.: 17/086,014

(22) Filed: Oct. 30, 2020

(65) Prior Publication Data

US 2021/0130085 A1 May 6, 2021

Related U.S. Application Data

(60) Provisional application No. 62/928,779, filed on Oct. 31, 2019.

(51) Int. Cl.

| | |
|---|---|
| ***B65D 88/30*** | (2006.01) |
| ***B65D 90/00*** | (2006.01) |
| ***B65D 90/02*** | (2019.01) |
| ***B65D 90/20*** | (2006.01) |

(52) U.S. Cl.
CPC ..... *B65D 88/30* (2013.01); *B65D 90/0033* (2013.01); *B65D 90/027* (2013.01); *B65D 90/20* (2013.01)

(58) Field of Classification Search
CPC ..... B65D 88/30; B65D 90/20
USPC ..... 220/1.5
See application file for complete search history.

(56) References Cited

U.S. PATENT DOCUMENTS

| | | | | |
|---|---|---|---|---|
| 8,585,341 | B1 * | 11/2013 | Oren | B65D 90/587 414/407 |
| 2006/0277783 | A1 * | 12/2006 | Garton | B65D 90/12 34/165 |
| 2013/0004275 | A1 | 1/2013 | Pylinski | |
| 2014/0083554 | A1 * | 3/2014 | Harris | B65D 88/54 141/1 |
| 2015/0069054 | A1 * | 3/2015 | Nolan | B65D 88/522 220/6 |

(Continued)

FOREIGN PATENT DOCUMENTS

| | | | | |
|---|---|---|---|---|
| EP | 3498634 | A1 | 6/2019 | |
| WO | WO-2015192061 | A1 * | 12/2015 | B61B 1/005 |
| WO | 2017095423 | A1 | 6/2017 | |

OTHER PUBLICATIONS

Office Action issued in Australian Application No. 2020376953; Dated Oct. 31, 2023 (4 pages).

*Primary Examiner* — Ernesto A Grano
*Assistant Examiner* — Symren K Sanghera
(74) *Attorney, Agent, or Firm* — Osha Bergman Watanabe & Burton LLP

(57) ABSTRACT

A corrugated storage container is provided that includes a box section with a top wall and corrugated side walls and end walls, a tapered funnel section extending downwardly from the box section and a frame supporting the box section and the funnel section. The frame includes vertical posts that are integrally joined with the box section and a base section formed at the lower end of the vertical posts and supporting the funnel section. The configuration of the corrugated storage container provides approximately 600 cubic feet of enclosed interior volume capable of storing between 50,000 and 51,000 pounds of bulk material.

7 Claims, 8 Drawing Sheets

(56) References Cited

U.S. PATENT DOCUMENTS

| | | | | |
|---|---|---|---|---|
| 2016/0039433 | A1* | 2/2016 | Oren | B61D 3/20 410/68 |
| 2016/0130095 | A1* | 5/2016 | Oren | B65D 88/28 220/23.91 |
| 2017/0320668 | A1* | 11/2017 | Gill | B65G 11/206 |
| 2018/0002066 | A1* | 1/2018 | Allegretti | B65D 88/022 |
| 2018/0093823 | A1* | 4/2018 | Hess | B65D 90/587 |
| 2018/0257857 | A1* | 9/2018 | Fisher | B65D 88/30 |
| 2019/0002196 | A1* | 1/2019 | Lucas | B65D 90/022 |
| 2020/0361704 | A1* | 11/2020 | Oren | B65D 88/32 |
| 2021/0086154 | A1* | 3/2021 | Noles | B01F 35/2111 |
| 2021/0155403 | A1* | 5/2021 | Martens | B65D 90/20 |

* cited by examiner

CORRUGATED STORAGE CONTAINER

CROSS-REFERENCE TO RELATED APPLICATIONS

This application claims the benefit of U.S. Provisional Application No. 62/928,779 filed on Oct. 31, 2019.

FIELD

The present disclosure relates to a container for storing bulk materials and, more particularly, a corrugated bulk storage container suitable of transporting, storing and dispensing proppant using in at a hydraulic fracturing operation.

BACKGROUND

This section provides background information related to the present disclosure which is not necessarily prior art.

Hydraulic fracturing is the propagation of fractions in a rock layer caused by the presence of pressurized fluid to release petroleum, natural gas, coal seam gas, or other substances for extraction. Fracturing is done from a wellbore drilled into reservoir rock formations. The energy from the injection of a highly pressurized fracking fluid creates new channels in the rock which can increase the extraction rates and ultimate recovery of fossil fuels. The fracture width is typically maintained after the injection by introducing a proppant into the injected fluid. Proppant is a material, such as grains of sand, ceramic, or other particulates, that prevents the fractures from closing when the injection is stopped.

A dominant proppant is silica sand, made up of ancient weathered quartz, the most common mineral in the Earth's continental crust. Unlike common sand, which often feels gritty when rubbed between the fingers, sand used as a proppant tends to roll to the touch as a result of its round, spherical shape and tightly graded particle distribution. Sand quality is a function of both deposit and processing. Grain size can be a key factor, as any given proppant must reliably fall within certain mesh ranges, subject to downhole conditions and completion design. Generally, coarser proppant allows for higher flow capacity due to the larger pore spaces between grains. It may break down, however, or crush more readily under stress due to the relatively fewer grain to grain contact points to bear the stress often incurred in deep oil and gas bearing formations.

Proppant conventionally used in fracturing operations must meet strict specification including moisture and turbidity requirements that require post-mining processes such as washing, screening and drying of the mined frac sand. Once so processed, proppant is relatively "slippery" and can be readily conveyed through handling equipment. Recent efforts to improve fracturing operations have focused on minimizing the post-mining processes of the fac sand by easing the specification for a suitable proppant and enabling use of "wet" or "dirty" proppant. Therefore, there is a need to provide improved material handling equipment that is capable of conveying proppant or other bulk materials having various characteristics.

SUMMARY

This section provides a general summary of the disclosure and is not a comprehensive disclosure of its full scope or all of its features.

Applicant has identified several issues associated with conventional fracturing processes. For example, Applicant has recognized that, in any hydraulic fracturing operation, a large amount of proppant is required, thus creating a need to effectively store the proppant at the fracturing sites. Applicant has also recognized the difficulty in effectively transporting proppant to and storing it at a desired location. Additionally, the maintenance of proppant in containers at the hydraulic fracturing site requires a large capital investment in storage facilities on a facility by facility basis. As such, there is a need to be able to effectively transport the proppant to and store the proppant in a desired location adjacent to the hydraulic fracturing location.

Applicant further has recognized that conventional storage containers are not optimized for storing and delivering large supplies of proppant to the outlet of a container. In particular, the structure of the container has not heretofore been designed with the goal of maximizing interior volume of the container. As such, the desired ability to transport over 50,000 pounds of proppant is compromised.

The embodiments disclosed herein provide for the enhanced transport and storage of proppant and includes a container having an upper box section and a lower funnel section and terminating at a bottom outlet. The box section includes a top wall, a pair of end walls and a pair of side walls extending between the pair of end walls. The funnel section includes a pair of side plates extending respectively from a lower edge of the pair of side walls and a pair of end plates extending respectively from a lower edge of the pair of end walls. The funnel section further includes radiused corner sections interconnecting adjacent end plates and side plates. The corner sections taper from a top edge adjacent the bottom of the end walls and side walls to a bottom edge adjacent the bottom outlet.

According to embodiments, each of the pair of side plates extends at an angle of greater than 31° with respect to the horizontal. In particular, each of the pair of side plates can extend at an angle of approximately 37° with respect to the horizontal. Likewise, the top edge of the radiused corner section has a radius of approximately 8 inches and the bottom edge of the radiused corner section has a radius of approximately 2 inches. The side plates and the end plate may be fabricated with stainless steel or plastic and/or coated with a non-stick layer such as a PTFE coating for reducing the coefficient of friction of the funnel section.

In embodiments, the interior volume of the container is approximately 600 cubic feet and is configured to store between 50,000 and 51,000 pounds of proppant. In this regard, the structural members of the container include L-shaped corner sections which are integrated with the side walls and end walls and provide additional storage capacity within the interior volume of the container. The corner section extends down from the box section to a base section. The frame further includes a plurality of horizontal beams arranged with respect to the sidewalls and the end walls of the container.

The top wall has an opening formed therein, which has a length substantially greater than one-half of the length of the top wall. The opening has a width less than one-half of the width of the top wall. A hatch is hingedly connected to the top wall. The hatch has an area greater than an area of the opening. The hatch is movable between an open position and a closed position to provide access to the opening. The bottom outlet may be provided with a gate that is movable between a first position closing the bottom outlet and a second position at least partially opening the bottom outlet.

While the corrugated storage container disclosed herein with particularly well suited for transporting, storing and dispensing proppant in a hydraulic fracturing operation, one skilled in the art should appreciate that the corrugated storage container will have utility in other applications and operations for transporting, storing and dispensing bulk materials of various kinds, character and quality. To this end, further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
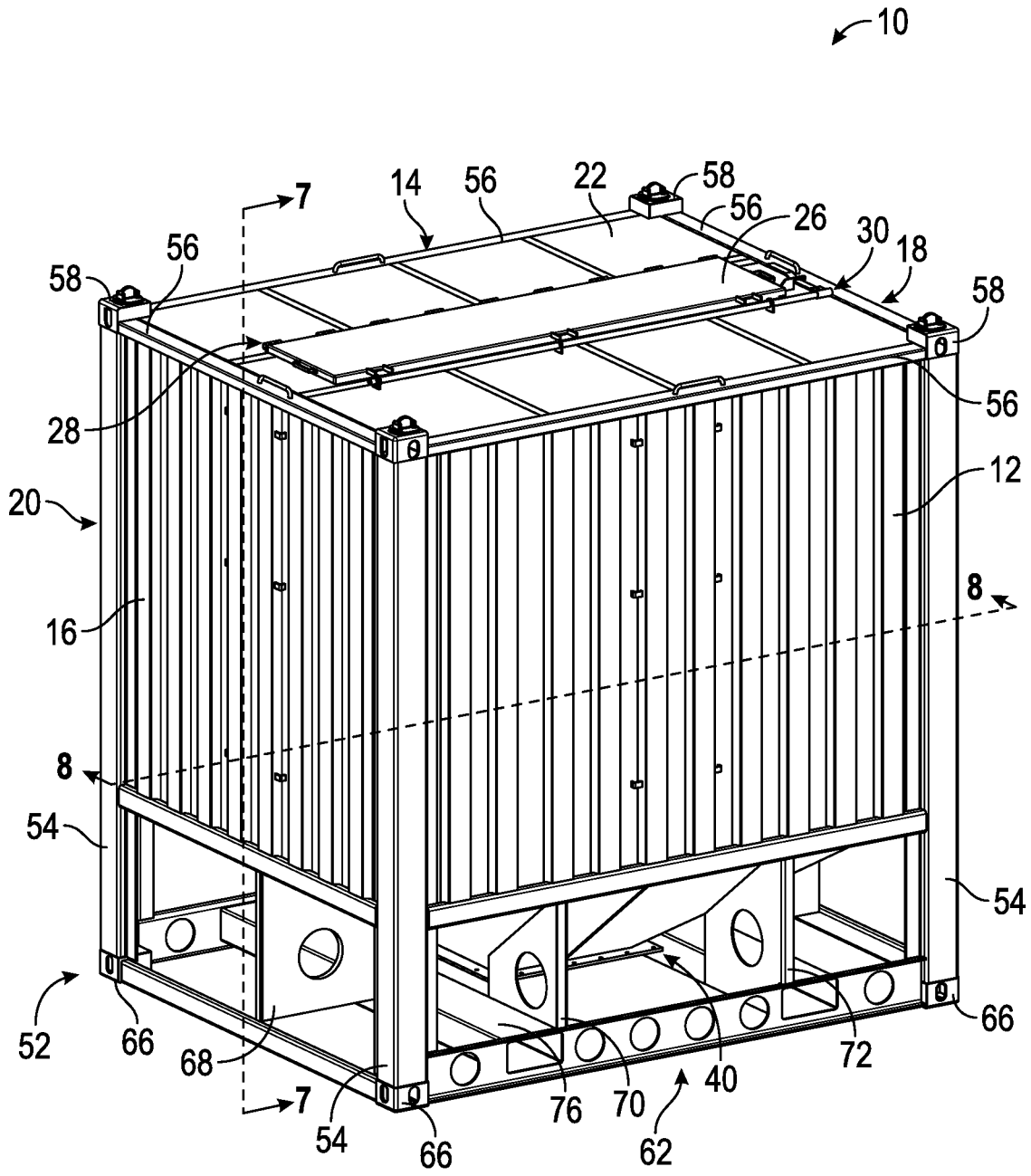
FIG. 1 is a front perspective view of a corrugated storage container further described below.
Figure 2:
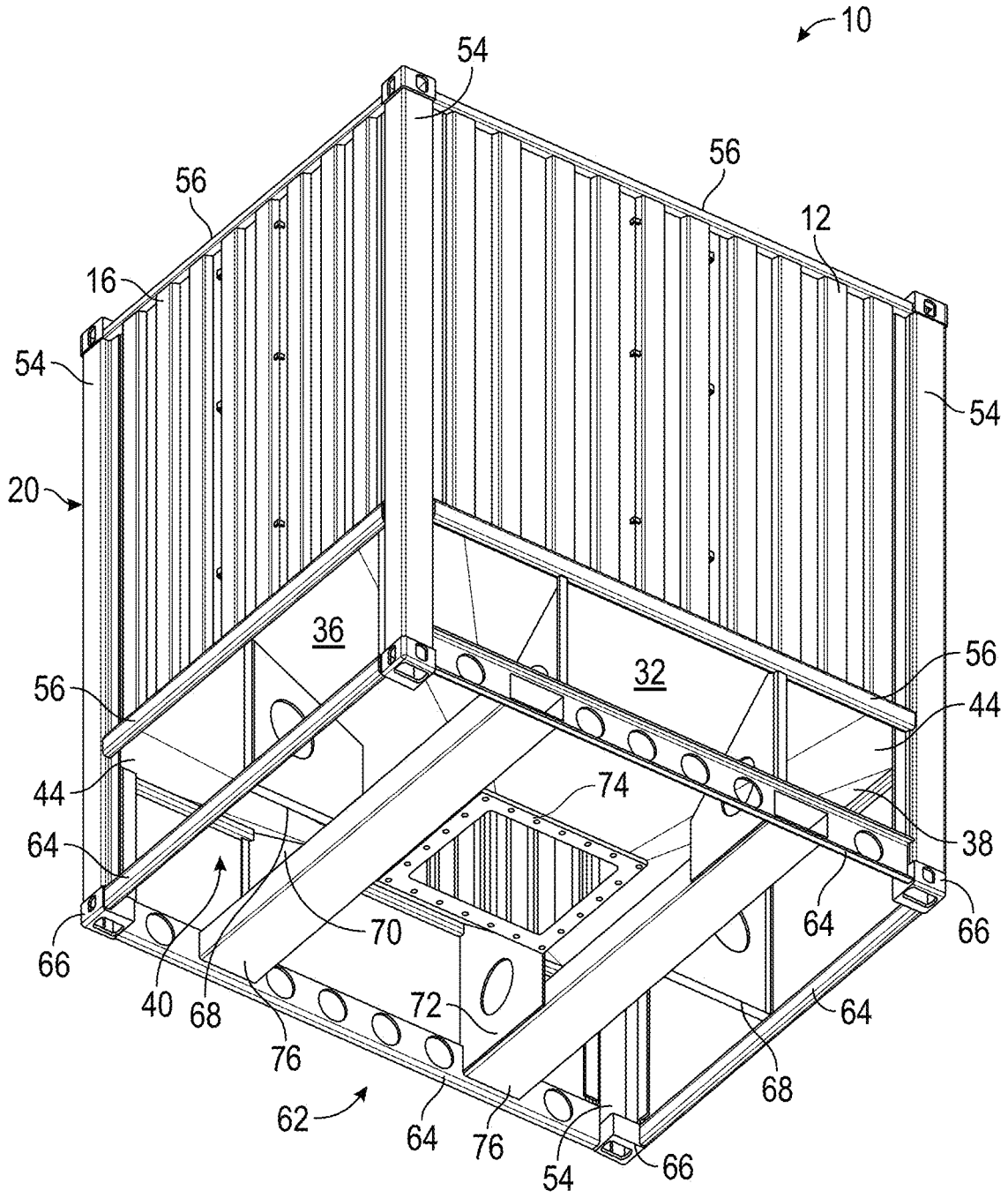
FIG. 2 is a bottom perspective view of the corrugated storage container.
Figure 3:
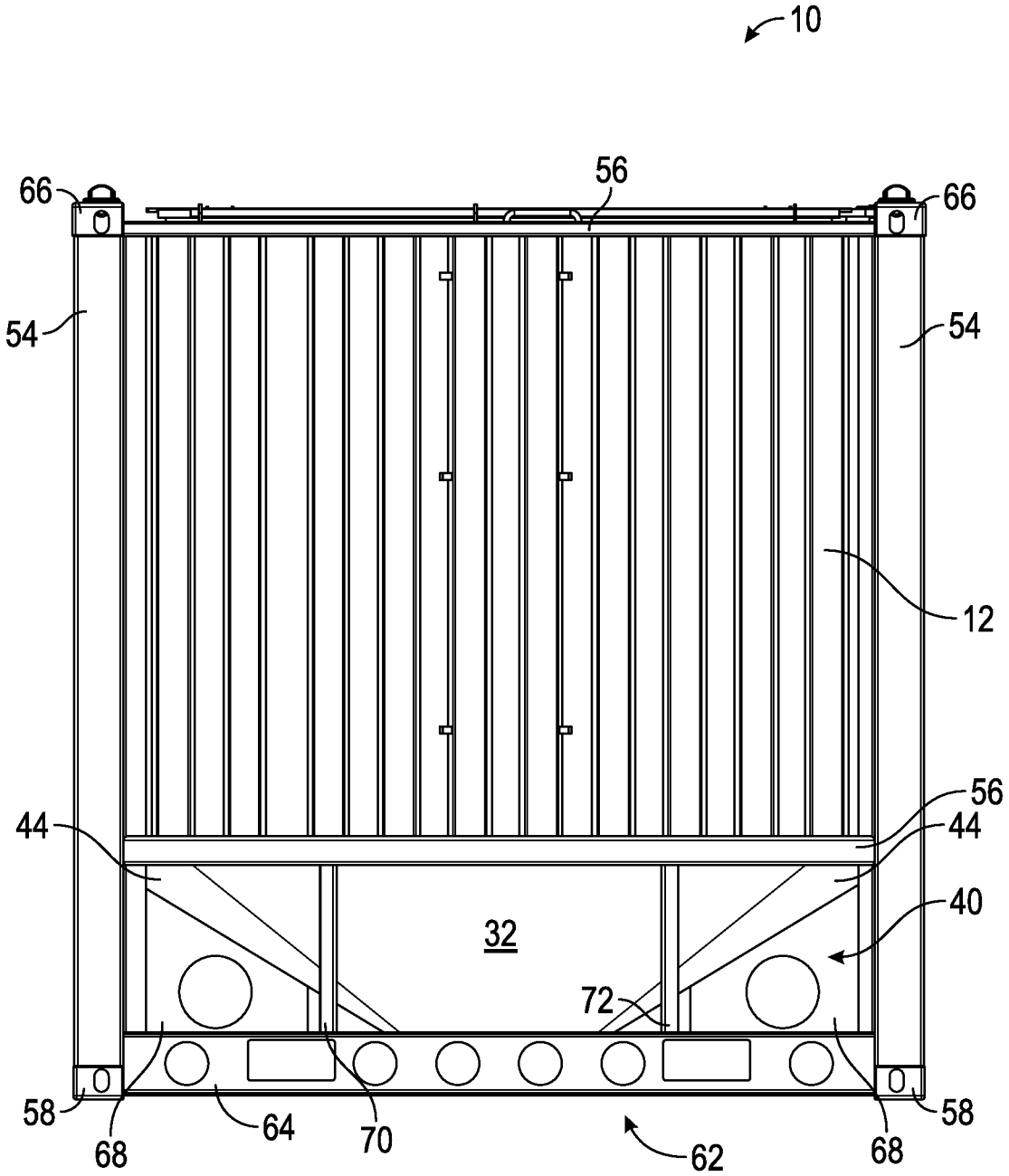
FIG. 3 is a front elevation of the corrugated storage container.
Figure 4:
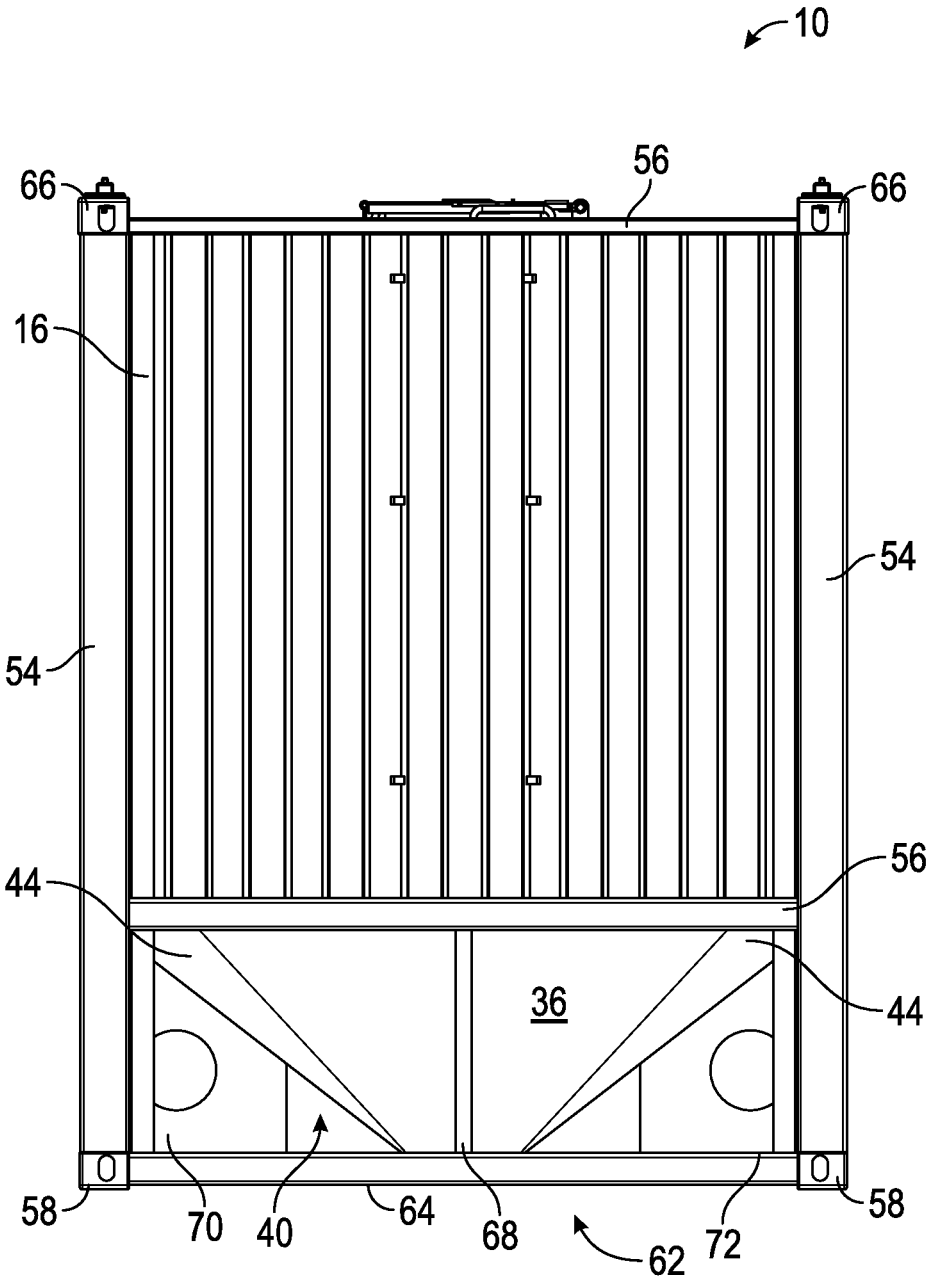
FIG. 4 is a right side elevation of the corrugated storage container, the left side elevation being a mirror image thereof.
Figure 5:
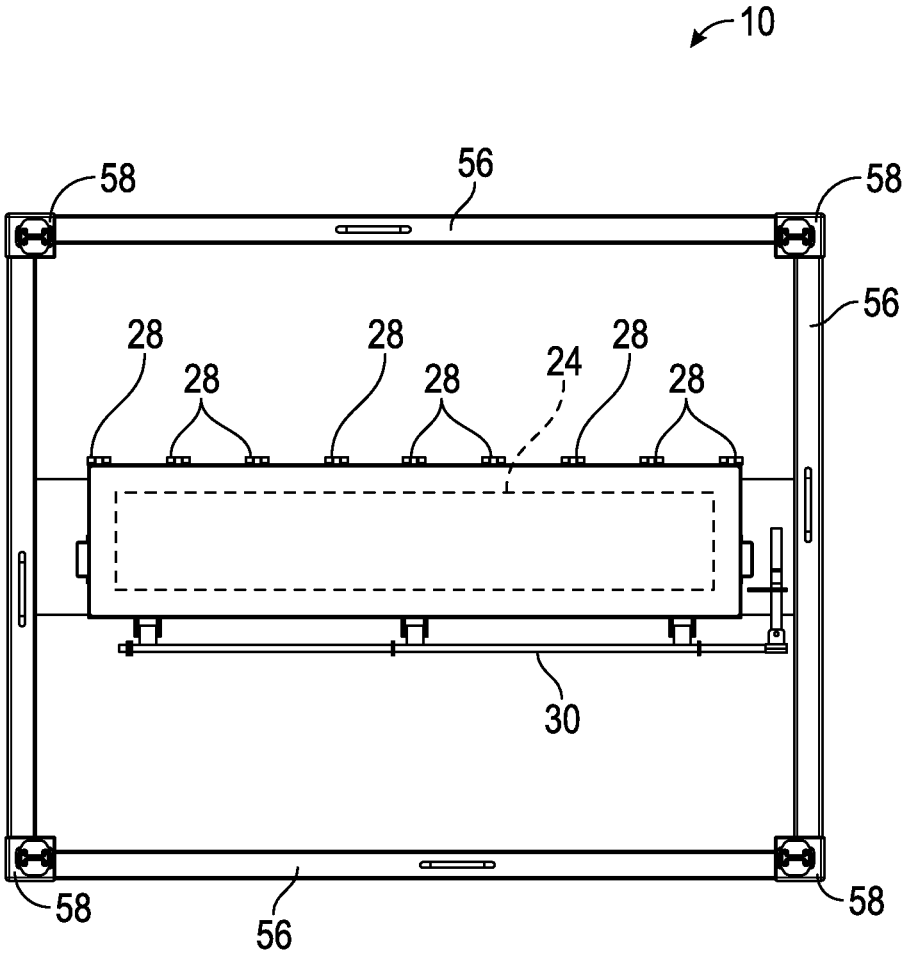
FIG. 5 is a top plan view of the corrugated storage container.
Figure 6:
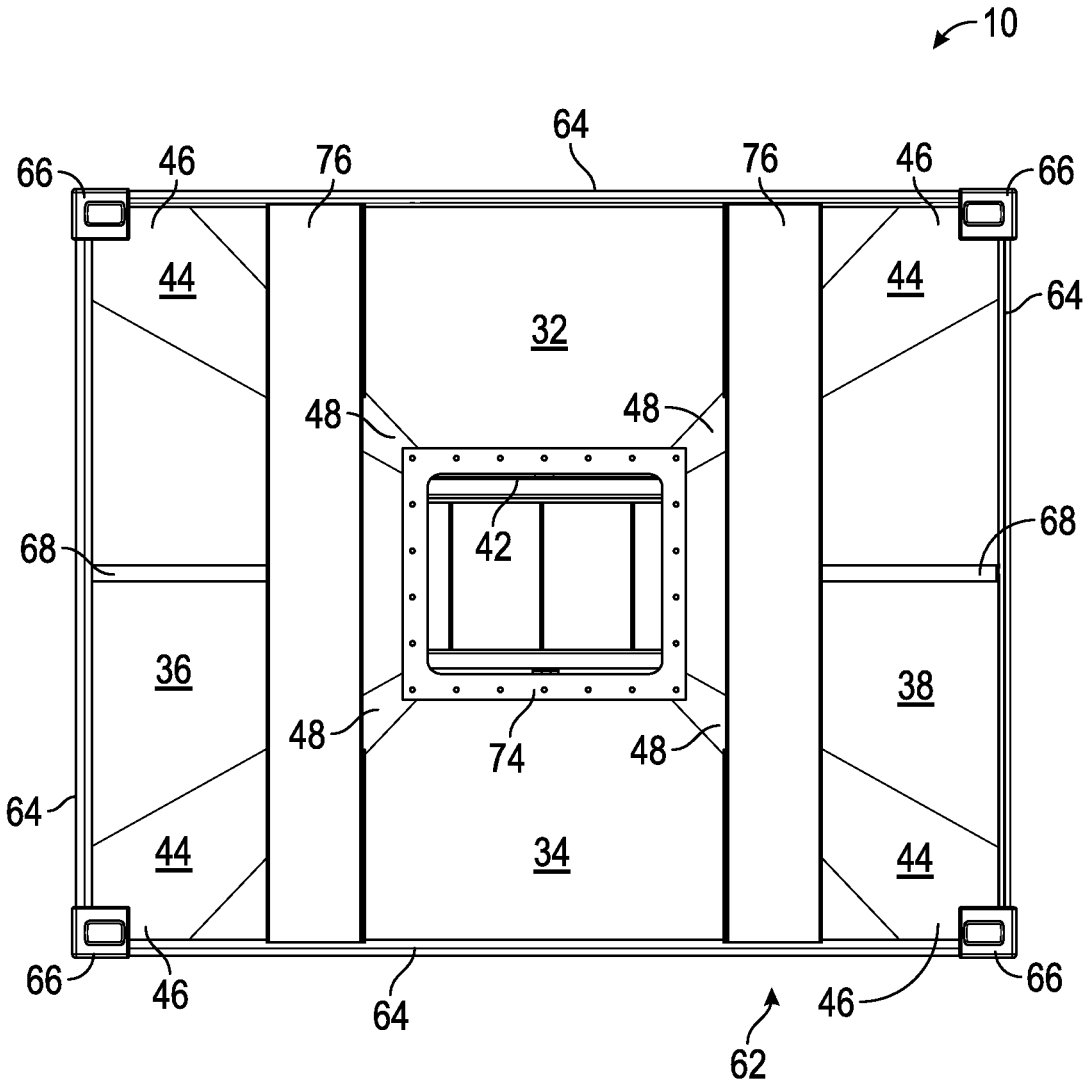
FIG. 6 is a bottom plan view of the corrugated storage container.

Example embodiments will now be described more fully with reference to the accompanying drawings.

FIGS. 1-8 show an exemplary container 10 for the transport and storage of bulk materials such as proppant. The container 10 includes a pair of side walls 12, 14 and a pair of end walls 16, 18. The side walls 12, 14 are positioned in spaced relationship by the end walls 16, 18 to form an upper rectangular or box structure or simply a box section 20 of the container 10. The side walls 12, 14 and end walls 16, 18 are fabricated using a corrugated sheet material forming vertically-oriented corrugated walls, which structurally reinforce the side walls 12, 14 and end walls 16, 18. Using corrugated sheet material in this manner eliminates the need for additional structural elements around the box section 20, which reduces the overall weight of the box section 20 such that the height of the box section 20 may be increased by approximately 10 inches as compared to conventional proppant containers. Additionally, the corrugations in the sheet material effectively increases the volume within the box section 20. A top wall 22 covers the top of the box section 20 and has an inlet 24 (FIG. 5) formed therein for providing access to an interior of the box section 20. A hatch 26 is mounted to the top wall 22 so as to cover the inlet 24 in the top wall 22.

In the example shown in the figures, the top wall 22 is of a generally planar surface, though it will be understood that the top wall 22 can include one or more surfaces positioned at various angles. The hatch 26 is connected by hinges 28 to the top wall 22. Latch 30 is used to secure the hatch 26 over the inlet 24 in the top wall 22 and may include a linkage (not shown) for manipulating the latch 30 to secure and release the hatch 26 from the ground in an area adjacent the box section 20. A liner material or seal may be affixed around the periphery of the hatch 26. This liner material can be of a rubber, elastomeric or polymeric material such that the contents of the container 10 are sealed within the interior of the container when the hatch 26 is properly closed over the inlet 24.

The inlet 24 can have a length which is substantially greater than one-half of the width (extending between the end walls 16, 18) of the top wall 22. The width of the inlet 24 is substantially less than the depth (extending between the side walls 12, 14) of the top wall 22. The elongated configuration of the inlet 24 assures that corrugated can be received properly and quickly into an interior volume of the container 10. The elongated nature of the inlet 24 avoids problems associated with restricted openings, such as small portholes, that could be formed on the top wall 22. The hatch 26 can be placed over the inlet 24. The hatch 26 can have an area slightly greater than the area of the inlet 24 to assure that the contents of the container 10 are retained properly therein in a liquid tight manner. As such, potential damaging effects of liquid penetration through the hatch 26 is effectively avoided. Furthermore, the placement of the hatch 26 over the inlet 24 further avoids the release of dust and silica particles from the interior of the container 10.

Figure 7:
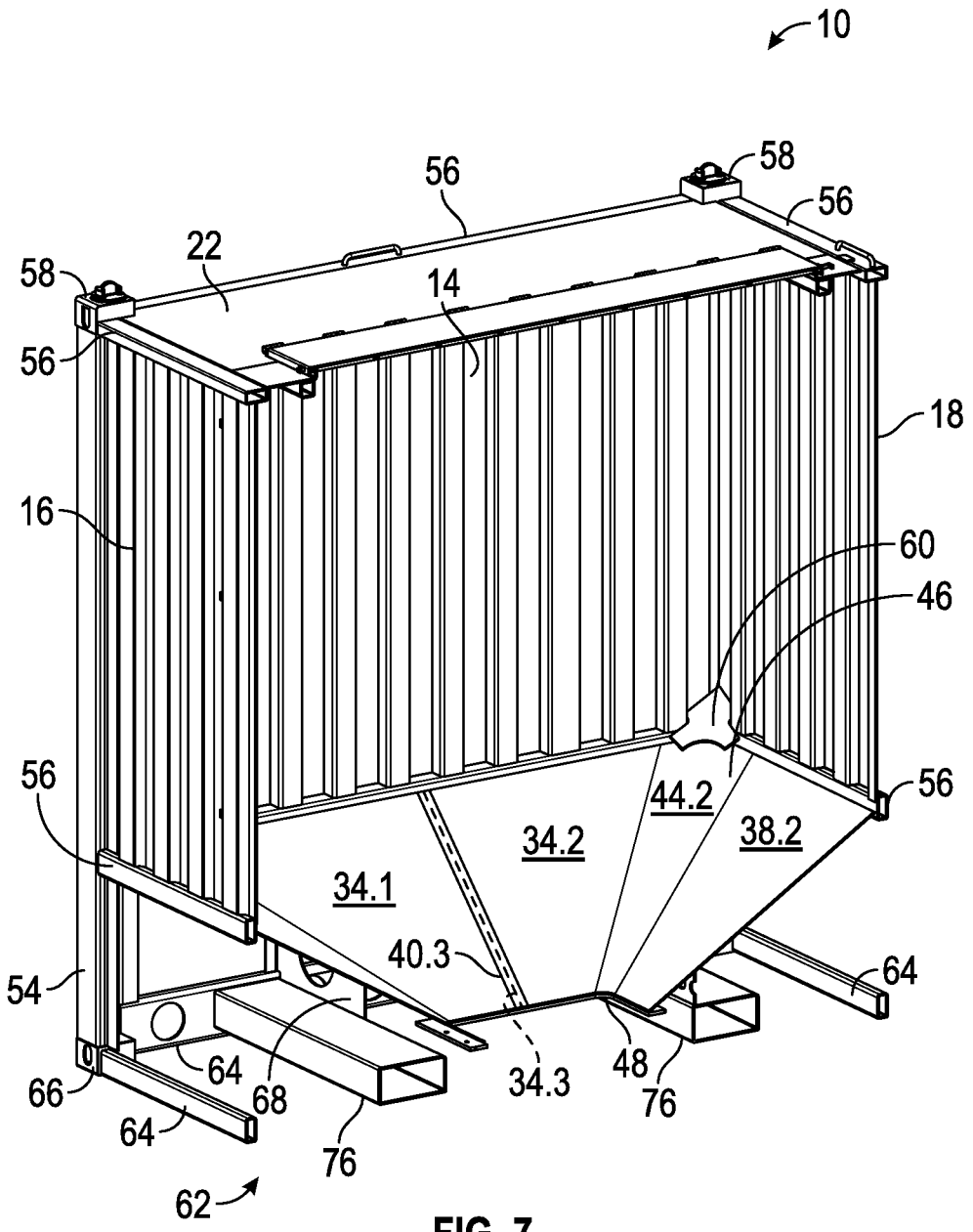
FIG. 7 is a vertical cross-section of the corrugated storage container taken along line 7-7 shown in FIG. 1.
Figure 8:
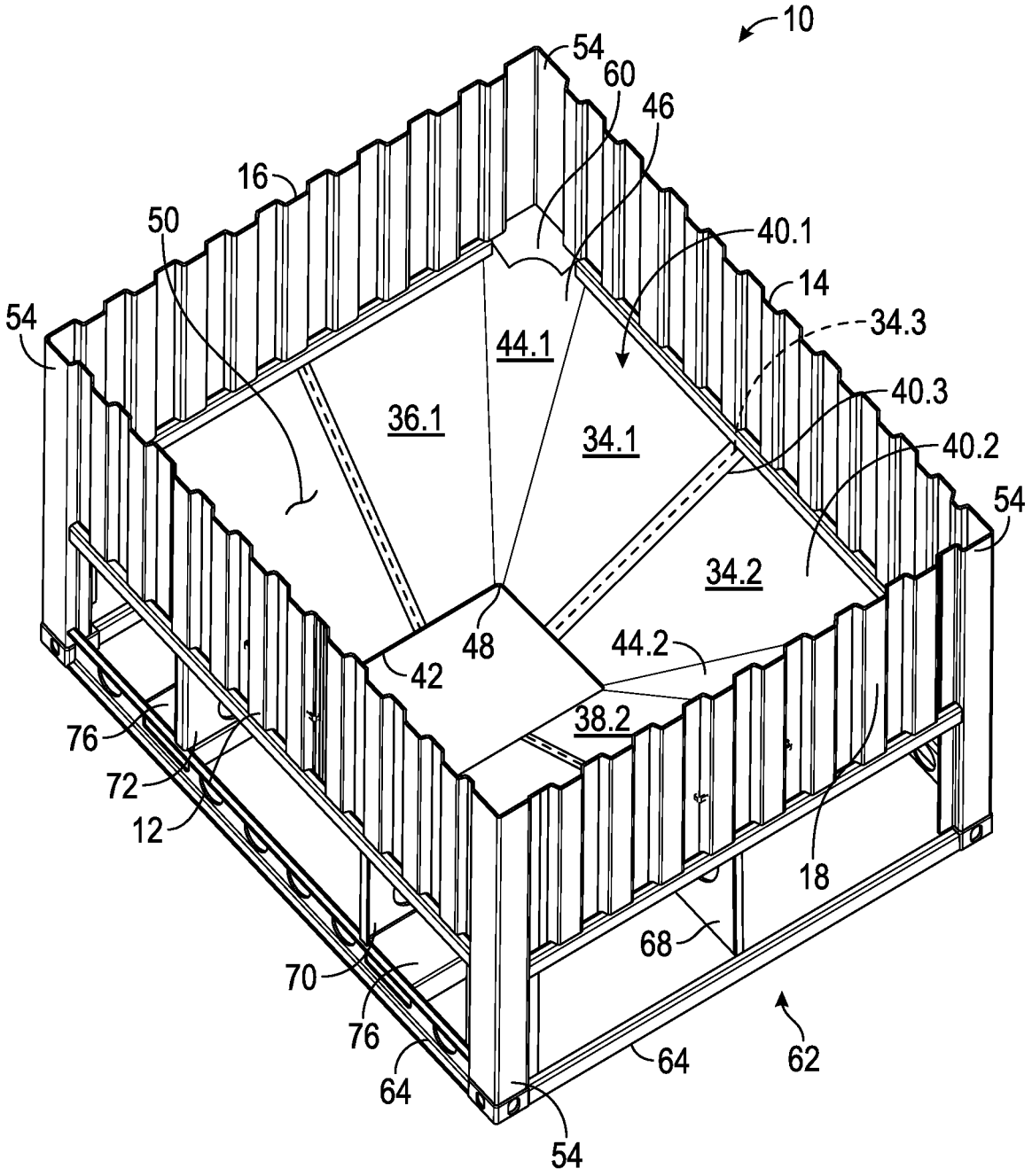
FIG. 8 is a horizontal cross-section of the corrugated storage container taken along line 8-8 shown in FIG. 1.

The container 10 also includes a pair of side plates 32, 34 extending from a lower edge of the side wall 12, 14 and a pair of end plates 36, 38 extending from a lower edge of the end walls 16, 18. A radiused corner section 44 is formed between a side plate 32, 34 and an adjacent end plate 36, 38. The corner section 44 tapers from an upper end 46 to a lower end 48 adjacent a bottom discharge opening or bottom outlet 42. The side plates 32, 34, end plates 36, 38 and radiused corner sections 44 form a lower cone-shaped or funnel structure or simply a funnel section 40, which extends downwardly from the box section 20 and terminates at the bottom outlet 42. In one embodiment, the funnel section 40 is fabricated by joining four sections together, wherein each section includes a portion of a side plate 32, 34, a radiused corner section 44 and a portion of an end plate 36, 38. For example as best seen in FIGS. 7 and 8, funnel section 40.1 is formed by a portion 34.1 of side plate 34, a radiused corner 44.1 and a portion 36.1 of end plate 36. Another funnel section 40.2 is formed by a portion 34.2 of side plate 34, a radiused corner 44.2 and a portion 38.2 of end plate 38. The funnel sections 40.1, 40.2 are welded together at a butt joint 40.3 formed along a medial line 34.3 of the side plate 34. The remainder of the funnel sections are formed in a similar manner. The box section 20 and the funnel section 40 together define an enclosed container storage volume 50 configured to store bulk materials such as proppant in the container 10. The container storage volume 50 is configured to receive bulk materials such as proppant through the upper inlet 24 and discharge the bulk material through the bottom outlet 42.

In some applications, the bulk material being transported and stored in the container 10 may have a relatively higher moisture or turbidity, such as wet or dirty proppant that has not been dried in post-mining operations. To this end, the radiused corner sections 44 provide a smooth transition between the side plates 32, 34 and the end plates 36, 38 that facilitates the smooth and continuous discharge of bulk material from the container 10. In addition, portions of the container 10 may be treated to facilitate handling of such bulk materials. For example, the side plates 32, 34 and the end plates 36, 38 may be fabricated using a stainless steel material or a plastic material for providing a slipperier surface than that of mild steel. Alternately and/or additionally, the interior surfaces of the side plates 32, 34 and the end plates 36, 38 (e.g. the surfaces forming the interior volume of the container) may be coated with a low friction coating such as a PTFE material for reducing the coefficient of friction of the interior surfaces.

A frame 52 includes vertical posts 54 disposed at the corners between adjacent side walls 12, 14 and end walls 16, 18 and extend downwardly past the bottom outlet 42. Cross beams 56 extend between vertical posts 54 along the upper and lower edges of the box section 20. A locating cap 66, similar to locating cap 58, is disposed at the upper end of vertical posts 54 and has a locating feature such as a pin formed thereon. As best seen in FIGS. 8 and 9, the vertical posts 54 have an L-shaped cross section with a first leg of the cross section welded to one of the side walls 12, 14 and a second leg of the cross section welded to one of the end walls 16, 18. In this way, the vertical posts 54 are integrated into the box section 20 to provide added storage capacity of the container 10. A plug plate 60 is located in each of the vertical posts 54 and provides a transition between the box section 20 and the funnel section 40 of the container 10. In particular, a top region of the plug plate 60 fits within the L-shaped cross section and a bottom region of the plug plate 60 matches with the upper end 46 of the radiused corner section 44. The plug plate 60 angles downwardly to direct bulk material stored in the vertical post 54 into the funnel section 40.

The frame 52 further includes a base section 62 which may be placed on the ground, on a vehicle bed or on a hopper stand, a conveyor assembly or similar support structures. The base section 62 includes cross beams 64 extending between the lower ends of the vertical posts 54. A locating cap 58 is disposed at the lower end of each vertical posts 54 and has a locating feature such as a receptacle formed therein for receiving a pin formed on the cap 58 so that storage containers 10 may be arranged in stacked relationship.

The base section 62 support the funnel section 40 and surrounds the bottom outlet 42. To this end, the base section 62 also includes an angular gusset 68 located beneath each side plate 32, 34 and a pair of angular gussets 70, 72 located beneath each end plate 36, 38. Each of the gussets 68, 70, 72 may have holes formed therethrough for reducing the weight of the base section 62 while, at the same time, preserving the structural integrity of the gussets 68, 70, 72. A rectangular shaped reinforcing plate 74 is affixed around the bottom outlet 42 so as to provide structural integrity thereto. A sliding gate mechanism (not shown) may be coupled to the reinforcing plate 74 adjacent to the bottom outlet 42 for enabling the controlled release of bulk material from the enclosed interior volume 50 of the container 10.

The gussets 68, 70, 72 extend inwardly from the cross beams 64 and terminate at tubular beams 76 for supporting the weight of the bulk material bearing on the funnel section 40 and provide a solid and stable configuration for the container 10. This arrangement of gussets has been found to optimize the structural integrity of the side plates and end plates for the support of the heavy weight of the bulk material within the interior of the container. The configuration of the angular gussets 68, 70, 72 establishes the angle of the side plates 32, 34 and end plates 36, 38, which are configured to maximize the amount of bulk material that can be contained within the interior volume of the container 10, while, at the same time, to discharge the entire contents within the enclosed interior volume 50 through the bottom outlet 42. In particular, the side plates 32, 34 extend at an angle of approximately 37° with respect to horizontal. Similarly, the end plates 36, 38 extend at an angle of approximately 31° with respect to horizontal.

Tubular beams 76 extend between the cross beams 64 beneath the side walls 12, 14. As best seen in FIG. 7, the tubular beams 76 are laterally spaced at a distance larger than the bottom outlet 42 so as not to impede the flow of bulk material from the container 10. The tubular beams 76 are configured to receive the forks of a forklift truck or similar lifting apparatus, which facilitates lifting and transporting of the container 10.

In an exemplary embodiment, the container 10 may have a width (i.e., between side walls 12, 14) of approximately 96 inches, a length (i.e. distance between end walls 16, 18) of approximately 118 inches, and a height (i.e., distance from grade to top of stacking cone) of approximately 127 inches. In this way, the container 10 is suitable for transportation on a railcar or on a trailer though one skilled in the art, after reading this specification, will understand that other modes of transportation are permissible as well. In order to transport the containers on highways, certain weight restrictions must be addressed. In order to comply with weight restrictions on roads, the total weight of a container 10 fully loaded with bulk material should be no greater than 52,000 pounds. Containers fabricated in accordance with the detailed description provided herein provides an enclosed interior volume of approximately 600 cubic feet and can safely store about 50,000-51,000 pounds of bulk material, while complying with the above-stated requirements. As previously noted, these containers are also configured for stacking such that a first container is located on the ground, a vehicle bed or on support structure and a second container is located on top of the first container. In this regard, the container 10 should be fabricated with materials having adequate strength and structural elements having sufficient stiffness to support the load of one or more container in a stacked relationship.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A container for the transport and storage of bulk material, the container comprising:

an upper box section having an upper interior volume, the upper box section including first and second corrugated side walls, first and second corrugated end walls, and a top wall having an inlet formed therein;

a lower funnel section having a lower interior volume disposed at a bottom of the upper box section opposite the top wall and terminating at an outlet, the lower funnel section including first and second side plates extending downwardly and inwardly from the first and second side walls, respectively, first and second end plates extending downwardly and inwardly from the first and second end walls, respectively, and a radiused corner section joining each of the first and second side plates with each of the first and second end plates;

a vertical post disposed between adjacent side walls and end walls to form corners therebetween, wherein each vertical post has an L-shaped cross section having a first flange joining a side wall and a second flange joining an end wall such that the vertical posts are integrated into the upper box section;

a plug plate located in each of the vertical posts, each plug plate having an upper region disposed within the vertical post and a lower region extending from the vertical post at an angle relative to the vertical post, the lower region having a curved cut-out portion, wherein each plug plate is formed to provide a downward transition between the upper box section and the lower funnel section for directing bulk material stored in the vertical post down into the lower funnel section; and a frame configured to support the upper box section and the lower funnel section, the frame including a first set of cross beams extending between an upper end of adjacent vertical posts, a second set of cross beams extending between adjacent vertical posts at the bottom of the upper box section, a third set of cross beams extending between the lower end of adjacent vertical posts, and an angular gusset located beneath each of the first and second side plates and each of the first and second end plates, wherein the angular gussets extend outwardly from the third set of cross beams to support the funnel section; and wherein the upper interior volume and the lower interior volume define a container storage volume for receiving bulk material through the inlet and discharging bulk material through the outlet.

2. The container according to claim 1, wherein the upper region of each plug plate is shaped to fit within the L-shaped cross section of the vertical post and the lower region is shaped to match an upper end of the radiused corner section of the lower funnel section.

3. The container according to claim 1, further comprising a hatch hinged on the top wall and movable between a closed position wherein the hatch covers and seals the inlet and an open position wherein the hatch reveals the inlet.

4. The container according to claim 1, wherein the frame further comprises an upper locating cap disposed in an upper end of each vertical post and a lower locating cap disposed in the lower end of each vertical post, wherein the locating caps have a locating feature formed therein for arranging the container in a stacked relationship with respect to another container.

5. The container according to claim 4, wherein the locating feature formed in the upper locating cap comprises a pin extending therefrom and the locking feature formed on the lower locating cap comprises a receptacle formed therein, wherein the pins on the upper locating cap of the container are configured to be received in the receptacles in the lower locating cap of the another container when arranged in a stacked relationship.

6. The container according to claim 1, wherein the funnel section further comprises a reinforcing plate affixed around the bottom outlet.

7. The container according to claim 1, wherein the funnel section further comprises a low friction coating formed on an interior surface thereof for reducing a coefficient of friction relative to an uncoated surface.

* * * * *